US007988518B2

(12) United States Patent
Kim et al.

(10) Patent No.: US 7,988,518 B2
(45) Date of Patent: Aug. 2, 2011

(54) MAGNETIC BLOCK TOY

(75) Inventors: Jong Sung Kim, Incheon (KR); Kyoung Woon Song, Seongnam-si (KR)

(73) Assignee: Edtoy Co., Ltd., Bupyeong-Gu, Incheon (KR)

( * ) Notice: Subject to any disclaimer, the term of this patent is extended or adjusted under 35 U.S.C. 154(b) by 162 days.

(21) Appl. No.: 12/440,933

(22) PCT Filed: Sep. 4, 2007

(86) PCT No.: PCT/KR2007/004248

§ 371 (c)(1),
(2), (4) Date: Mar. 12, 2009

(87) PCT Pub. No.: WO2008/032948

PCT Pub. Date: Mar. 20, 2008

(65) Prior Publication Data

US 2010/0075567 A1 Mar. 25, 2010

(30) Foreign Application Priority Data

Sep. 13, 2006 (KR) ..... 10-2006-0088369

(51) Int. Cl.
*A63H 33/26* (2006.01)

(52) U.S. Cl. ..... 446/92; 446/129

(58) Field of Classification Search ..... 446/71, 446/72, 92, 129–139, 168; 434/211–215, 434/190, 208, 277–279, 301; 273/156, 157 R, 273/456

See application file for complete search history.

(56) References Cited

U.S. PATENT DOCUMENTS

| | | | | |
|---|---|---|---|---|
| 2,970,388 | A * | 2/1961 | Yonkers | 434/277 |
| 5,152,711 | A * | 10/1992 | Gross | 446/139 |
| 6,749,480 | B1 | 6/2004 | Hunts | |
| 6,846,216 | B1 * | 1/2005 | Balanchi | 446/85 |
| 6,969,294 | B2 * | 11/2005 | Vicentelli | 446/92 |
| 7,413,493 | B2 | 8/2008 | Toht et al. | |
| 2004/0116038 | A1 * | 6/2004 | Hunts | 446/92 |
| 2006/0240737 | A1 * | 10/2006 | Yoon | 446/92 |
| 2007/0287353 | A1 * | 12/2007 | Vicentelli | 446/92 |

FOREIGN PATENT DOCUMENTS

| | | |
|---|---|---|
| JP | 09-140855 | 6/1997 |
| KR | 10-2004-0065186 | 7/2004 |

OTHER PUBLICATIONS

International Search Report dated Dec. 21, 2007.
U.S. Office Action issued in U.S. Appl. No. 12/408,132 dated Mar. 24, 2011.

* cited by examiner

*Primary Examiner* — Nini Legesse
(74) *Attorney, Agent, or Firm* — KED & Associates LLP

(57) ABSTRACT

A magnetic block toy is provided that includes a plurality of magnetic blocks coupled to one another by magnets therein. Each of the magnetic blocks includes a body part having two or more end portions and a magnet-mounting part at each end portion of the body part adapted to mount magnets having different polarities on upper and lower surfaces thereof so as to be rotatably supported by a shaft formed on both sides of an outer periphery thereof. When one magnetic block approaches another magnetic block, the magnets are rotated to cause the magnetic blocks to be coupled to each other irrespective of a coupling direction. When the magnetic blocks are coupled to each other, they do not slide against or separate from each other.

5 Claims, 4 Drawing Sheets

[Fig. 1]
PRIOR ART
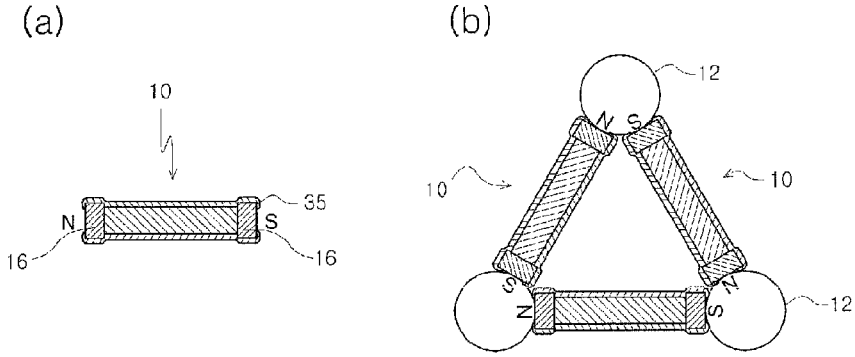
[Fig. 2]
PRIOR ART
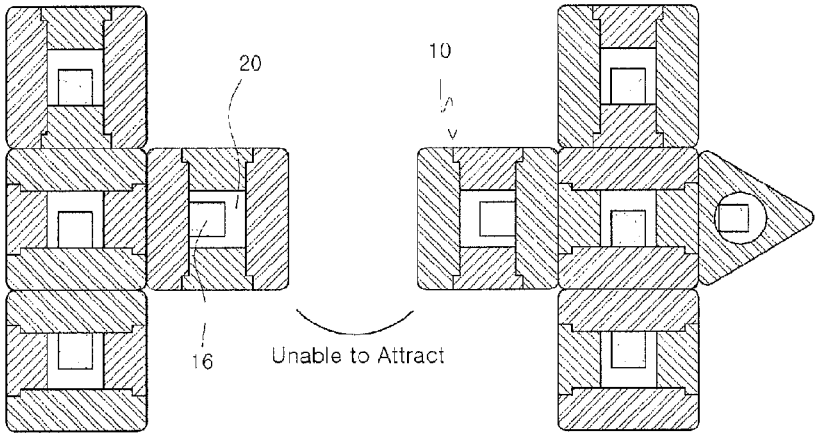
[Fig. 3]
PRIOR ART
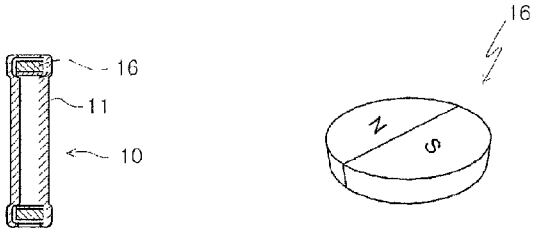
[Fig. 4]
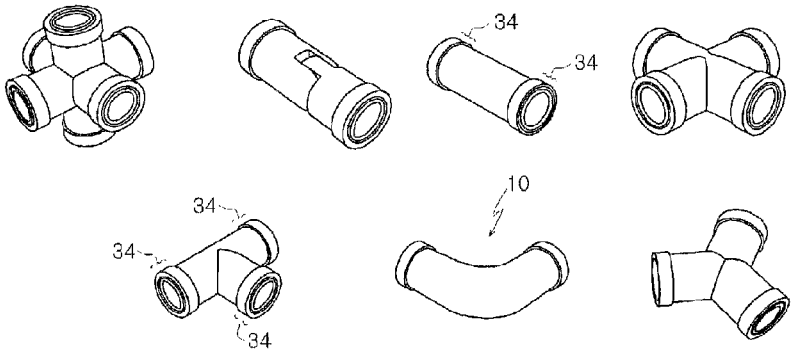

[Fig. 5]
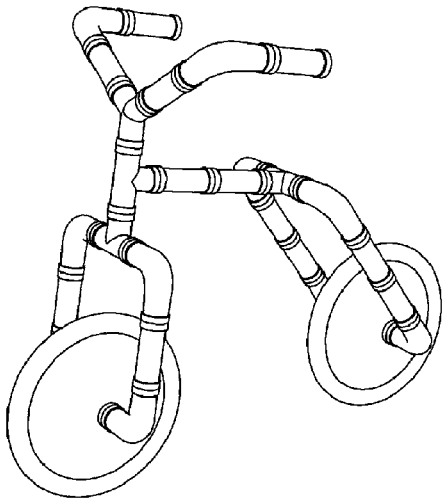
[Fig. 6]
(a)
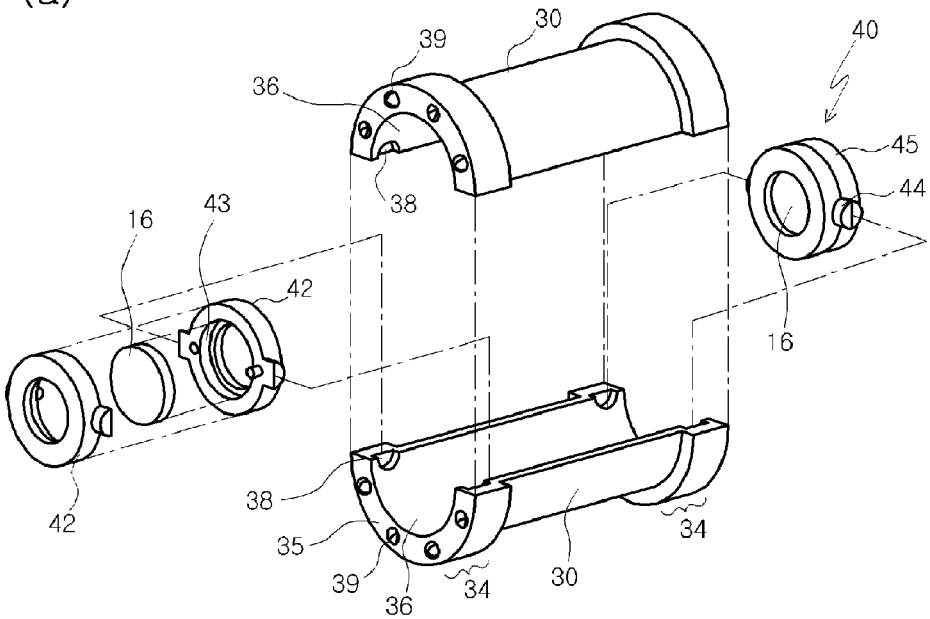
(b)
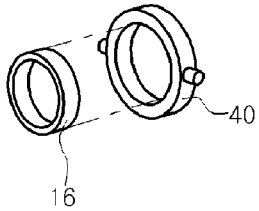

[Fig. 7]
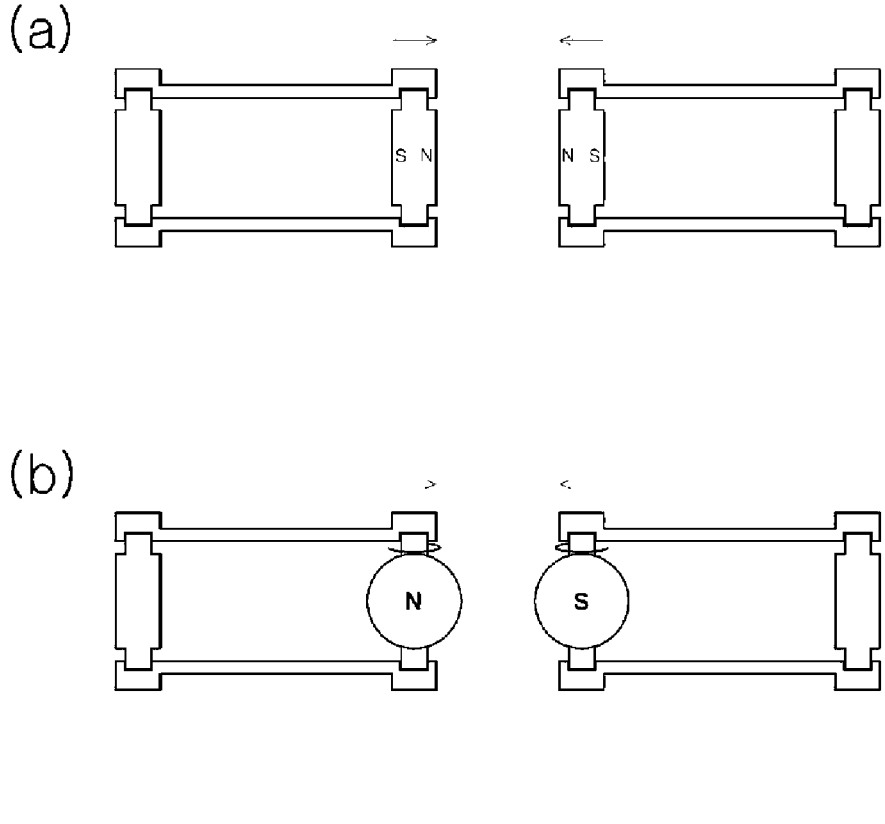
[Fig. 8]
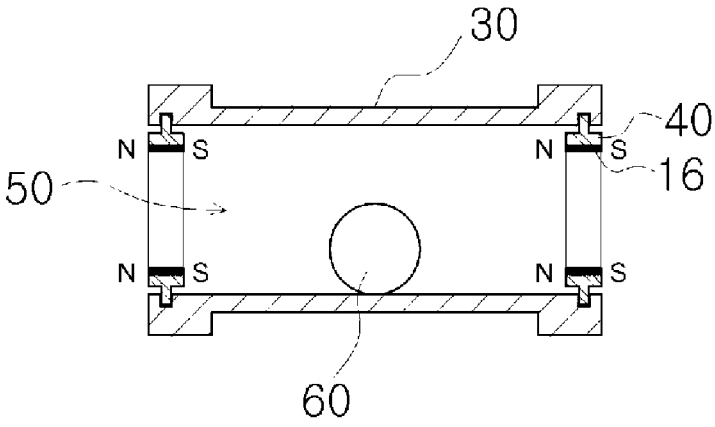

[Fig. 9]
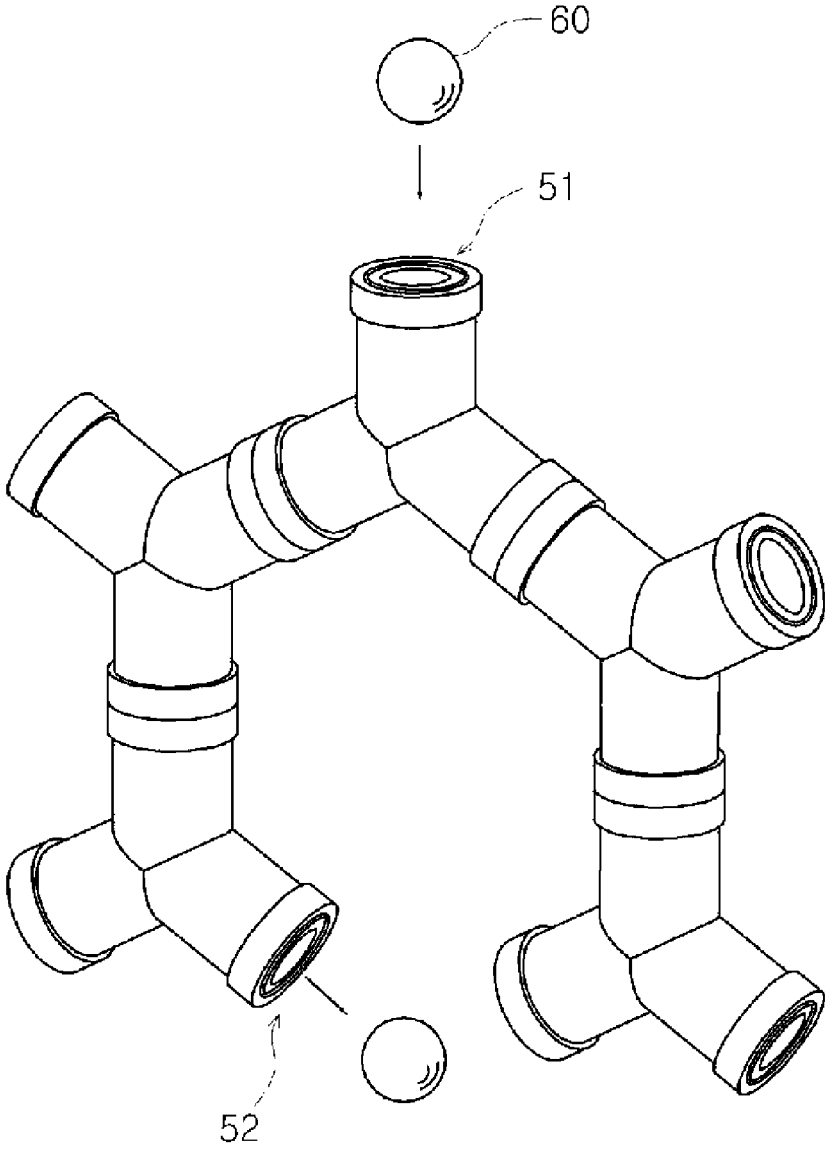
[Fig. 10]
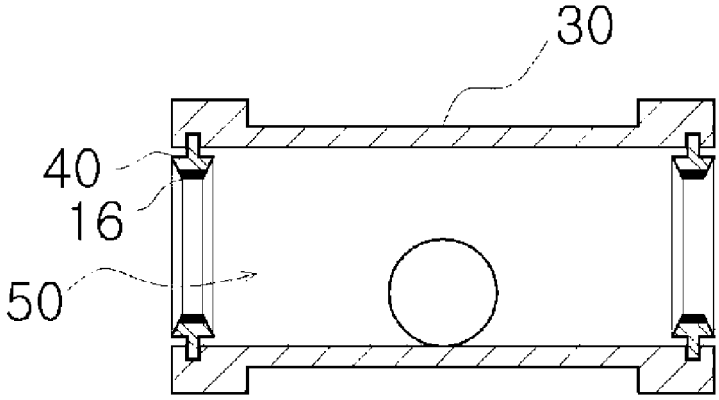

MAGNETIC BLOCK TOY

TECHNICAL FIELD

The present invention relates to a magnetic block toy, and more particularly, to a magnetic block toy that is provided with a body part having at least two or more end portions and with a magnet-mounting part adapted to mount magnets having different polarities on the upper and lower surfaces thereof in such a manner as to be rotatably supported by means of a shaft formed on the both sides of the outer periphery thereof to each end portion of the body part, so that when the magnetic block approaches another magnetic block, the magnets are rotated to cause the magnetic blocks coupled to each other irrespective of the coupling direction, and once the magnetic blocks are coupled to each other, they are not slid against and separated from each other.

BACKGROUND ART

Generally, a block toy that is capable of improving children's creative minds is mainly configured such that it has a plurality of convex protrusions formed on one or more sides thereof and a plurality of concave insertion grooves on another side thereof, so that the children play with the toy block by fittedly inserting the protrusions into the insertion grooves.

Unlike a press-fit toy block as widely used until now, recently, a block toy that uses a magnet as a block-coupling means has been developed and obtains much popularity.

A conventional magnetic block toy as shown in FIG. 1 includes a block 10 having magnets 16 of N and S poles respectively disposed on the both end portions thereof and a metal ball 12 as a magnetic material adapted to couple the block 10 with another block 10, thereby assembling a variety of articles. By the way, in a case where the metal ball 12 is not adopted as a coupling means, the end portions 35 of the block 10 having the same polarities as each other can not be coupled to each other according to their properties, so that there occurs an inconvenience that one of the blocks 10 should be turned by 180°

So as to the problems the conventional magnetic block toy has had, thus, there is provided another type of the conventional magnetic block toy as disclosed in Korean Patent No. 545658. According to the conventional practice, a magnet 16 is inserted into a space portion 20 within a block 10, as shown in FIG. 2, and if the block 10 faces another block 10, the magnets 16 of the space portions 20 of the blocks 10 are rotated to couple each other.

However, under the above structure of the conventional practice as mentioned above, the internal space portion where the magnet is rotated should be necessarily needed, thereby failing to reduce the size of the block, and even though the block is made small, the magnet in the block should be small, thereby failing to obtain a substantially strong magnetic force. Furthermore, even after a unit article is assembled, it can not be coupled to another unit article. To solve this problem, the internal space portion may be more enlarged to insert a plurality of magnets thereinto. In this case, however, there occur some problems that the reduction of the block size can not be achieved and children can not recognize the corresponding block having the plurality of magnets therein.

So as to couple the blocks with no metal ball as a magnetic material, on the other hand, there is provided another type of conventional magnetic block toy as disclosed in Korean Utility Model Registration No. 404030, wherein a magnet 16 is inserted into the end portions of the block 10, the magnet 16 being exposed on each end surface of the block 10 and having two or more polarities on the surface thereof, as shown in FIG. 3, so that the magnets 16 are rotated horizontally in the block 10. However, the magnets 16 are not gently rotated by the frictional force against the an outer cover 11 of the block 10, and the magnet 16 having the two polarities on one surface thereof is expensive, which undesirably raises the total production costs.

DISCLOSURE OF INVENTION

Technical Problem

Accordingly, the present invention has been made to solve these problems, and it is an object of the present invention to provide a magnetic block toy that does not need any metal ball as a magnetic material, while assembling, and that is coupled to another magnetic block by using a general magnet having different polarities on the both surfaces thereof, but not by using the magnet having two different polarities on one surface thereof.

It is another object of the present invention to provide a magnetic block toy that is capable of moving a ball or a fluid into an assembled block, thereby developing children's creative minds and scientific ideas.

Technical Solution

To achieve the above objects, there is provided a magnetic block toy including a plurality of blocks coupled to one another by means of a magnetic force, wherein the magnetic block includes: a generally coin-like magnet having N and S poles arranged on the upper and lower surfaces thereof; a magnet-mounting part having a cylindrical case for allowing the magnet to be mounted at the center thereof and a shaft formed integrally on opposed both sides of the outer periphery of the cylindrical case; and a body part consisting of two half bodies connected together, the body part having two or more end portions, each end portion having a shaft-fixing portion formed on the inner periphery thereof so as to fixedly support the shaft of the magnet-mounting part thereto, and a space portion formed at the inside thereof so as to internally house the magnet-mounting part supported by the shaft and the shaft-fixing portion to cause the magnet-mounting part to pivotally rotate therein.

According to the features of the present invention, preferably, the body part, the magnet, and the case have a through-hole formed to pass through the center thereof, the through-hole having a size enough to insert and pass a ball into the block.

According to the features of the present invention, preferably, the end portions of the body part have a sliding prevention mechanism formed on the end edge surfaces thereof, so that when the magnetic block is coupled to another magnetic block adjacent thereto, the sliding between the end edge surfaces is prevented.

According to the features of the present invention, preferably, the end portions of the body part have a sealing layer formed on the end edge surfaces thereof, so that when the magnetic block is coupled to another magnetic block adjacent thereto, a fluid is not leaked between the end edge surfaces coupled to each other.

According to the features of the present invention, preferably, the body part is made of a transparent or semi-transparent material.

Advantageous Effects

According to the present invention, there is provided a magnetic block toy that does not need any metal ball as a magnetic material, while assembling, and that is coupled to another magnetic block by using a general magnet having different polarities on the both surfaces thereof, not by using the magnet having two different polarities on one surface thereof, thereby effectively assembling more various shapes of articles. Moreover, the magnetic block toy of the present invention moves a ball or a fluid into an assembled block, thereby developing children s creative minds and scientific ideas, and as a general magnet having different polarities on the both surfaces thereof is adopted, the total production costs can be substantially reduced.

BRIEF DESCRIPTION OF THE DRAWINGS

FIG. 1 is a sectional view showing a structure of a conventional magnetic block toy.

FIG. 2 is a sectional view showing another structure of the conventional magnetic block toy.

FIG. 3 is a sectional view showing still another structure of the conventional magnetic block toy.

FIG. 4 is a perspective view showing various outer shapes of the magnetic block toy according to the present invention.

FIG. 5 is a perspective view showing an article made by using the magnetic block of the present invention.

FIG. 6 is an exploded perspective view showing a structure of the magnetic block toy according to the present invention.

FIG. 7 is a sectional view showing the principle where the magnetic block toy is coupled cooperatively to another magnetic block.

FIG. 8 is a sectional view showing another shape of the magnetic block toy according to the present invention.

FIG. 9 is a perspective view showing an article made by using the magnetic block of FIG. 8.

FIG. 10 is a sectional view showing another shape of the magnet-mounting part and the magnet of the magnetic block of the present invention.

MODE FOR THE INVENTION

Hereinafter, an explanation on a magnetic block toy according to the present invention will be given with reference to the attached drawings.

FIG. 4 is a perspective view showing various outer shapes of the magnetic block toy according to the present invention, FIG. 5 is a perspective view showing an article made by using the magnetic block of the present invention, and FIG. 6 is an exploded perspective view showing a structure of the magnetic block toy according to the present invention.

As shown in FIG. 4, the magnetic block 10 of the present invention has various shapes having two or more end portions 34, and if the end portions 34 of the magnetic block 10 are coupled to those of another magnetic block 10, the bicycle as shown in FIG. 5 can be made.

According to the present invention, hereinafter, a bar-like magnetic block 10 having two end portions 34 will be explained, but it is easily understood to those skilled in the art that a magnetic block having three or more end portions can be of course adopted.

As shown in FIG. 6, the magnetic block 10 according to the present invention largely includes a body part 30, a magnet 16, and a magnet-mounting part 40.

The magnet 16 used in the present invention is a general magnet having round upper and lower surfaces having different polarities from each other.

The magnet 16 is insertedly mounted into a case 42. As shown in FIG. 6, the case 42 is divided into two pieces, and each of the divided case pieces has a magnet-mounting groove 43 formed along the inner periphery thereof, for mounting the magnet 16 thereinto. After the magnet 16 is fittedly inserted into the magnet-mounting groove 43, the divided case pieces are coupled to each other to allow the magnet 16 to be mounted therein. Further, the case 42 has a shaft 44 protrudedly formed on the both sides of the outer periphery 45 thereof, thereby providing the magnet-mounting part 40.

According to the present invention, cases having every shape may be adopted if they can mount the magnet thereinto. For instance, the case may be formed of a relatively thin cylindrical unitary case having inner and outer peripheries, and the magnet is attached by means of adhesive into the cylindrical case. Otherwise, the case having a groove formed along the inner periphery thereof may be formed of a flexible material, and the magnet can be fittedly inserted into the groove of the case.

When the magnet as shown in FIG. 6 is mounted into the case, it is exposed on the upper and lower surfaces thereof to the outside, but it is possible that it is not exposed by the case.

As shown in FIG. 6, the magnetic block 10 has the body part 30 having two end portions 34, and each of the end portions 34 has a shaft-fixing portion 38 adapted to fixedly insert the shaft 44 of the magnet-mounting part 40 thereinto. The shaft-fixing portion 38 is made by forming a hole on the inner periphery thereof, and after the shaft 44 of the magnet-mounting part 40 is fitted to the shaft-fixing portion 38, the body part 30 having two half bodies separated in a lengthwise direction from each other are coupled to mount the magnet on each end portion thereof.

However, the mounting of the magnet-mounting part 40 onto the body part 30 is not limited to shown in FIG. 6. For example, a unitary body part may have a groove formed on the inner periphery of the end portion thereof, for inserting the shaft thereinto, and after the magnet-mounting part is fittedly inserted into the groove from the end portion of the body part, a finishing member is adopted to block the groove, thereby achieving the mounting of the magnet-mounting part to the unitary body part. Otherwise, the body part may have a groove adapted to insert the shaft in a lengthwise direction thereof on the inner periphery of the end portion thereof, and the groove has an inlet portion formed smaller than the diameter of the shaft. Thus, the body part is formed of a flexible material, and as the inlet portion of the groove is flexibly deformed, the shaft is inserted into the groove, thereby achieving the mounting of the magnet-mounting part to the body part. Once the magnet-mounting part is mounted to the body part, it does not escape from the body part since the inlet portion of the groove is smaller than the diameter of the shaft.

Further, the diameter of the outer periphery 45 of the magnet-mounting part 40 is smaller than that of the inner periphery of the end portion 34 of the body part 30, and in this case, the difference between the diameters of the magnet-mounting part 40 and the body part 30 is enough to rotate the magnet-mounting part 40 after the magnet-mounting part 40 is assembled with the body part 30 by means of the shaft-fixing portion 38. Of course, it will be obvious to those skilled in the art that the rotation is gently achieved when the central portion of the inner periphery of the end portion 34 of the body part 30 and the central portion of the outer periphery 45 of the magnet-mounting part 40 are the same as each other.

In addition, the body part 30 as shown in FIG. 6 is formed or a hollow cylinder, but even though it may be formed of a solid cylinder blocked at the center thereof, it has a space portion 36 formed on the end portion 34 thereof so as to house the magnet-mounting part 40 therein, thereby smoothly rotating the magnet-mounting part 40.

The inner space portion forming the cylindrical body 30 part as shown in FIG. 6 serves as the magnet-mounting part-housing space portion.

The shaft 44 is formed on the magnet-mounting part 40 and the shaft-fixing portion 38 is on the body part 30, in FIG. 6. However, it is possible that the shaft 44 is formed on the body part 30 and the shaft-fixing portion 38 is on the magnet-mounting part 40, thereby rotatably mounting the magnet-mounting part 40 on the body part 30 through the variations of the mounting method as mentioned above. At this time, the variations are in an equal relation with the coupling.

FIG. 7 is a sectional view showing the principle where the magnetic block toy is coupled cooperatively to another magnetic block, wherein even though the magnets of the end portions to be coupled have the same polarities as each other (see FIG. 7*a*), the magnets push each other by the same polarities when the end portions approach each other, so that the magnets are rotated by means of the shaft and the magnet-mounting part is also rotated by the rotation force of the magnets (see FIG. 7*b*). Then, the magnets facing each other in the two adjacent blocks stop at the positions having different polarities from each other by the rotation of the magnet-mounting part and the magnetic forces are generated between the two blocks, thereby coupling the two blocks with each other (see FIG. 7*c*).

Since the magnetic blocks are coupled as mentioned above, a variety of articles can be made. In this case, however, the coupled end edge surfaces may slid against each other by the weight of the blocks themselves, which causes the assembled magnetic blocks to be often separated from each other.

So as to prevent the assembled magnetic blocks from being separated from each other, thus, it is preferable that a sliding prevention mechanism 39 having protrusions and indents formed alternately at equal intervals on both end edge surfaces 35 of the body part 30, as shown in FIG. 6. Thus, the protrusions and the indents of one block are coupled correspondingly with the indents and the protrusions of another block to be coupled thereto, thereby preventing the sliding between the end edge surfaces of the adjacent blocks.

The sliding prevention mechanism 39 is not limited to the protrusions and the indents as shown in FIG. 6, but it may be formed by concavo-convexes formed continuously in a radial shape on both end edge surfaces 35 of the body part 30.

FIG. 8 shows another shape of the magnetic block toy according to the present invention, wherein a ring-like magnet 16 is adopted, and the body part 30, the magnet 16, and the case 42 have a through-hole 50 formed to pass through the center thereof.

Thus, children make an article having an inlet 51 and a plurality of outlets 52 as shown in FIG. 9 with the blocks each having the through-hole as shown in FIG. 8, and they play with the article by putting a ball 60 into the inlet 51 to check that which outlet 52 discharges the ball 60.

The through-hole 50 has a size enough to insert and pass the ball 60 into the block.

The magnet 16 and/or the case 42 may have a convex portion formed inclinedly toward the central portion of the inner periphery thereof, as shown in FIG. 10, so as to gently pass the ball through the block.

At this time, the body part 30 is preferably formed of a transparent or semi-transparent material, so as to observe the ball 60 moving from the inlet 51 to the outlet 52 of the assembled blocks.

On the other hand, if a sealing layer (which is not shown) like rubber or silicon is formed on the end edge surface 35 of the block, water is not leaked between the coupled end edge surfaces. Thus, if the article as shown in FIG. 9 is made with the block having the sealing layer formed on the end edge surfaces thereof, children can use water instead of the ball.

INDUSTRIAL APPLICABILITY

According to the present invention, there is provided a magnetic block toy that does not need any metal ball as a magnetic material, while assembling, and that is coupled to another magnetic block by using a general magnet having different polarities on the both surfaces thereof, not by using the magnet having two different polarities on one surface thereof. Moreover, the magnetic block toy of the present invention moves a ball or a fluid into an assembled block, thereby developing children's creative minds and scientific ideas.

The invention claimed is:

1. A magnetic block toy, comprising:

a plurality of magnetic blocks coupled to one another by a magnetic force, wherein each of the plurality of magnetic blocks comprises:

a body part comprising two half bodies connected together, the body part having two or more end portions, each end portion having a space portion, the space portion having a shaft-fixing portion formed on a surface thereof;

a cylindrical case provided with a shaft, which is rotatably inserted in the space portion of the body part, wherein the shaft of the cylindrical case is rotatably inserted in the shaft fixing portion; and a coin-like magnet having a north (N) pole on one surface thereof and a south (S) pole on another surface thereof, the coin-like magnet being mounted in the cylindrical case, wherein a plurality of protrusions and indents are formed alternately at equal intervals or concavo-convexes are formed continuously in a radial shape on an end surface of each of the end portions of the body part, so that when the end portion of the body part of one of the plurality of magnetic blocks is coupled to the end surface of the end portion of the body part of another of the plurality of magnetic blocks by the magnets, the two end surfaces are prevented from sliding with respect to each other.

2. The magnetic block toy according to claim 1, wherein the body part is made of a transparent or semi-transparent material.

3. The magnetic block toy according to claim 1, wherein the cylindrical case includes inner and outer peripheries, and wherein the coin-like magnet is attached into the inner periphery of the cylindrical case.

4. The magnetic block toy according to claim 3, wherein the coin-like magnet is attached into the inner periphery of the cylindrical case by an adhesive.

5. The magnetic block toy according to claim 3, wherein the cylindrical case includes a groove formed of a flexible material along the inner periphery of the cylindrical case and the coin-like magnet is fittingly inserted into the groove of the cylindrical case.

* * * * *